US009685288B2

(12) United States Patent
Melchior et al.

(10) Patent No.: US 9,685,288 B2
(45) Date of Patent: Jun. 20, 2017

(54) CONNECTION PIECE FOR A SWITCH POLE OF A SWITCHING APPARATUS

(71) Applicant: Siemens Aktiengesellschaft, Munich (DE)

(72) Inventors: Rainer Melchior, Berlin (DE); Fabian Roehrig, Berlin (DE); Unni Suresh, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 15/032,647

(22) PCT Filed: Oct. 14, 2014

(86) PCT No.: PCT/EP2014/071984
§ 371 (c)(1),
(2) Date: Apr. 28, 2016

(87) PCT Pub. No.: WO2015/062857
PCT Pub. Date: May 7, 2015

(65) Prior Publication Data

US 2016/0260562 A1 Sep. 8, 2016

(30) Foreign Application Priority Data

Nov. 4, 2013 (DE) ..... 10 2013 222 319

(51) Int. Cl.
*H01H 33/664* (2006.01)
*H01H 1/58* (2006.01)
(Continued)

(52) U.S. Cl.
CPC ..... *H01H 33/664* (2013.01); *H01H 1/5833* (2013.01); *H01H 33/6606* (2013.01); *H01H 2033/6665* (2013.01)

(58) Field of Classification Search
CPC ..... H01H 33/666; H01H 33/66207; H01H 33/6606; H01H 2033/6623;
(Continued)

(56) References Cited

U.S. PATENT DOCUMENTS 5,239,150 A * 8/1993 Bolongeat-Mobleu H01H 33/122 218/84
5,597,992 A 1/1997 Walker
(Continued)

FOREIGN PATENT DOCUMENTS

CN 1302499 C 2/2007
DE 8535717 U1 2/1986
(Continued)

OTHER PUBLICATIONS

German Office Action mailed Jul. 23, 2014.
(Continued)

*Primary Examiner* — Truc Nguyen
(74) *Attorney, Agent, or Firm* — Harness, Dickey & Pierce, P.L.C.

(57) ABSTRACT

A connection piece is disclosed for a switch pole of a switching apparatus which improves the properties of the switch pole as concerns centering and current-carrying capacity. According to an embodiment of the invention, a connection piece for a switch pole of a switching apparatus is provided for connecting in electrically conductive manner to a movement contact connection pin of a vacuum switching tube disposed in the switch pole. The connection piece includes a centering ring for centering the vacuum switching tube, the centering ring being formed from an electrically conductive material and being connected in electrically conductive manner via at least one connector to a connection region of the connection piece.

16 Claims, 2 Drawing Sheets

(51) Int. Cl.
*H01H 33/66* (2006.01)
*H01H 33/666* (2006.01)

(58) Field of Classification Search
CPC ..... H01H 33/66261; H01H 33/6661; H01H 33/662; H01H 33/664; H01H 2033/6665; H01H 33/6643; H01H 33/6642; H01H 2033/66284; H01H 33/596
See application file for complete search history.

(56) References Cited

U.S. PATENT DOCUMENTS 5,808,258 A * 9/1998 Luzzi ..... H01H 33/66207 218/136
6,396,018 B1 * 5/2002 Kinoshita ..... C10M 169/00 218/120
6,649,854 B1 * 11/2003 Bauer ..... H01H 33/666 218/120
2005/0092713 A1 5/2005 Chyla et al.
2006/0086694 A1 * 4/2006 Benke ..... H01H 33/666 218/154
2009/0078681 A1 * 3/2009 Marchand ..... H01H 33/6606 218/140
2009/0200270 A1 * 8/2009 Chen ..... H01H 33/6606 218/119
2011/0120976 A1 * 5/2011 Gentsch ..... H01H 9/52 218/139
2013/0075368 A1 * 3/2013 Marchand ..... H01H 33/662 218/140
2015/0034598 A1 * 2/2015 Kim ..... H01H 33/6606 218/140
2015/0114932 A1 * 4/2015 Reuber ..... H01H 33/6606 218/137

FOREIGN PATENT DOCUMENTS

GB 1206297 A 9/1970
JP 2009021124 A 1/2009
WO WO-03071567 A1 8/2003
WO WO-2007016882 A1 2/2007

OTHER PUBLICATIONS

International Search Report PCT/ISA/210 for International Application No. PCT/EP2014/071984 dated Feb. 4, 2015.
Written Opinion of the International Searching Authority PCT/ISA/237 for International Application No. PCT/EP2014/071984 dated Feb. 4, 2015.
Chinese Office Action for Corresponding Chinese Application No. 201480060883.3 issued on Mar. 3, 2017.

* cited by examiner

CONNECTION PIECE FOR A SWITCH POLE OF A SWITCHING APPARATUS

PRIORITY STATEMENT

This application is the national phase under 35 U.S.C. §371 of PCT International Application No. PCT/EP2014/071984 which has an International filing date of Oct. 14, 2014, which designated the United States of America and which claims priority to German patent application number DE 102013222319.6 filed Nov. 4, 2013, the entire contents of which are hereby incorporated herein by reference.

FIELD

An embodiment of the invention generally relates to a connection piece for a switch pole of a switching apparatus.

BACKGROUND

WO 2007/016882 A1 discloses a switch pole of a switching apparatus, in which a vacuum interrupter is centered and held in the pole housing via a centering ring. In this case, a flexible strip is provided for electrically conductively connecting a moving contact connection pin to a connection piece of the switch pole.

SUMMARY

At least one embodiment of the present invention is directed to a connection piece for a switch pole of a switching apparatus. With such a connection piece, the switch pole of at least one embodiment has improved properties in respect of centering and current-carrying capacity.

According to at least one embodiment of the invention, a connection piece is disclosed for a switch pole of a switching apparatus for electrically conductive connection to a moving contact connection pin of a vacuum interrupter which is arranged in the switch pole. The connection piece has a centering ring for centering the vacuum interrupter. In at least one embodiment, the centering ring is formed from an electrically conductive material and is electrically conductively connected to a connection region of the connection piece by way of at least one connection device or connector.

In a switch pole for a switching apparatus of at least one embodiment, for example a medium-voltage circuit breaker for switchgear assemblies in the field of energy distribution, the connection piece is provided firstly for electrically conductively connecting the moving contact connection pin of a vacuum interrupter which is arranged in the switch pole and secondly for connection to a current-carrying component of the switchgear assembly in which the switching apparatus is provided for switching or interrupting a current which is carried via the switchgear assembly.

BRIEF DESCRIPTION OF THE DRAWINGS

Explanation will occur in greater detail below on the basis of the drawing and also an example embodiment with reference to the appended figures, in which.

DETAILED DESCRIPTION OF THE EXAMPLE EMBODIMENTS

Figure 1:
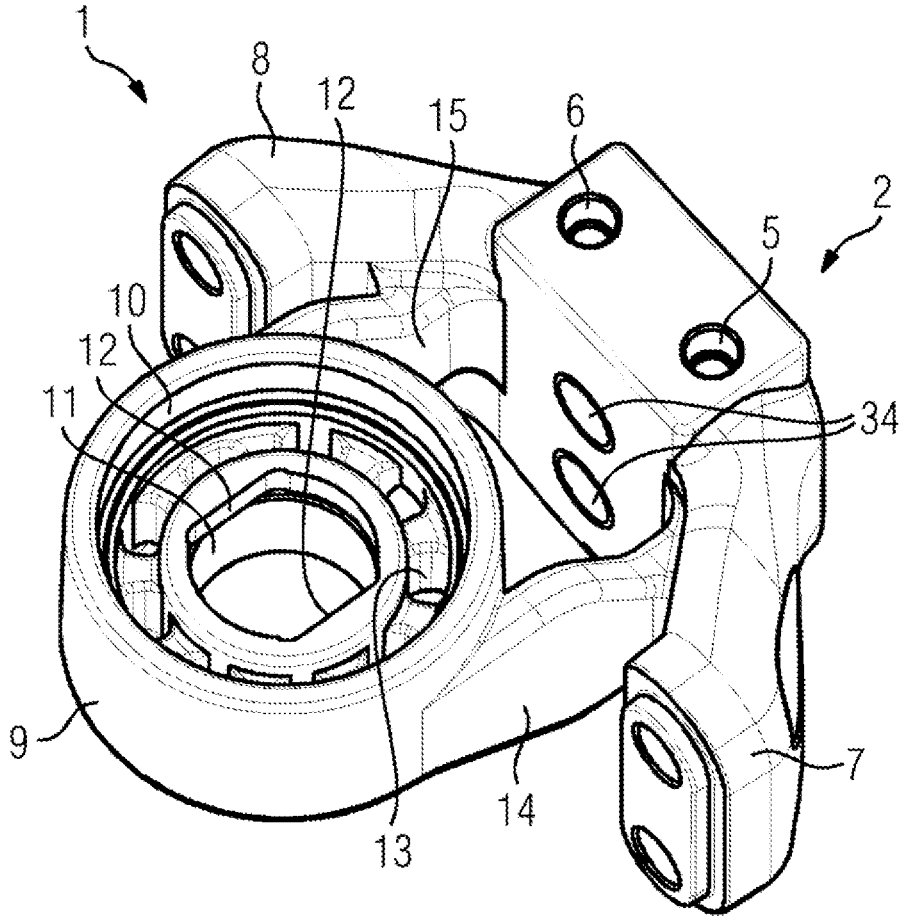
FIG. 1 shows a three-dimensional view of an example embodiment of a connection piece according to an example embodiment of the invention.

According to at least one embodiment of the invention, a connection piece is disclosed for a switch pole of a switching apparatus for electrically conductive connection to a moving contact connection pin of a vacuum interrupter which is arranged in the switch pole. The connection piece has a centering ring for centering the vacuum interrupter. The centering ring is formed from an electrically conductive material and is electrically conductively connected to a connection region of the connection piece by way of at least one connection device or connector.

In a switch pole for a switching apparatus of at least one embodiment, for example a medium-voltage circuit breaker for switchgear assemblies in the field of energy distribution, the connection piece is provided firstly for electrically conductively connecting the moving contact connection pin of a vacuum interrupter which is arranged in the switch pole and secondly for connection to a current-carrying component of the switchgear assembly in which the switching apparatus is provided for switching or interrupting a current which is carried via the switchgear assembly.

A switching apparatus of this kind is typically of three-phase design with one pole for each phase and is connected to a control device, which control device sends the switching apparatus a control signal for switching or interrupting the current which is carried via the switching apparatus.

The connection piece according to at least one embodiment of the invention is particularly advantageous in this process and leads to improved properties of the switch pole because, owing to the centering ring which is electrically conductively connected to a connection region of the connection piece by way of at least one connection device or connector and is mechanically coupled to said connection region, a current path is formed between the moving contact connection pin of the vacuum interrupter and the connection region, which current path, together with a flexible strip which connects the moving contact connection pin to the connection piece, leads to an increased current-carrying capacity of the switch pole.

In an advantageous refinement of at least one embodiment of the invention, the centering ring has a bushing guide for the moving contact connection pin in the form of an electrically conductive sliding bearing. The electrically conductive sliding bearing of the bushing guide for the moving contact connection pin of the vacuum interrupter in the centering ring firstly increases the current-carrying capacity of the switch pole, because the additional current path to the current path which is formed by way of the flexible strip is formed by way of the electrically conductive sliding bearing and the centering ring and also the electrically conductive connection means of the connection piece for connecting the centering ring to the connection piece, and secondly allows reliable guidance of the moving contact connection pin of the vacuum interrupter through the bushing guide.

In a particularly advantageous refinement of at least one embodiment of the invention, the centering ring has ventilation openings. Ventilation openings of this kind in the centering ring provide a cooling effect on the connection piece, as a result of which the current-carrying capacity of the entire arrangement is further improved.

In a further advantageous refinement of at least one embodiment of the invention, the bushing guide is provided with bearing faces which correspond to a width across flats of the moving contact connection pin. Bearing faces of this kind in the bushing guide with a width across flats which corresponds to the width across flats of the moving contact connection pin are particularly advantageous because assembly of the switch pole is simplified as a result because, particularly when mounting and centering the vacuum interrupter, the moving contact connection pin of the vacuum interrupter does not have to be held separately, but rather is held and secured against rotation by the bearing face of the bushing guide.

FIG. 1 shows a three-dimensional view of a connection piece 1 for electrically conductive connection to a moving contact connection pin of a vacuum interrupter (not illustrated in FIG. 1) which is arranged in a switch pole of a switching apparatus. The connection piece 1 has a connection region 2 which has a pair of fasteners 3 and 4 for electrically conductive connection to current-carrying components of the switchgear assembly in which the switching apparatus is used. Furthermore, fasteners 5, 6 are provided for fastening a flexible strip (explained in greater detail further below with reference to FIG. 2). The flexible strip is likewise electrically conductively connected to the moving contact connection pin of the vacuum interrupter of the switching apparatus. Further fasteners 7, 8 are provided for fastening the connection piece 1 to the switch pole or to the pole housing which is typically formed from an insulating material.

The connection piece 1 further comprises a centering ring 9, the inside diameter 10 of which corresponds to the outside diameter of the vacuum interrupter of the switch pole, so that the centering ring 9 is suitable for centering and holding the vacuum interrupter. The centering ring 9 has a bushing guide 11 through which a moving contact connection pin of the vacuum interrupter can extend and in which the moving contact connection pin of the vacuum interrupter is guided.

Furthermore, bearing faces 12 are provided above the bushing guide 11, the width across flats of the bearing faces corresponding to a width across flats of the moving contact connection pin, so that a rotation-prevention device for the moving contact connection pin is formed at the same time as the switch pole is mounted and, respectively, the vacuum interrupter is fitted. Ventilation openings, of which only one is provided with the designation 13 by way of example, are provided within the centering ring 9 in order to allow and to ensure air circulation and in this way to make a contribution to the cooling effect on the entire arrangement.

Connectors 14 and 15 connect the centering ring 9 to the connection region 2 of the connection piece 1 and fasten the centering ring 9 to the connection region 2. In this way, they form the connection piece 1. The connection piece 1 overall, that is to say also, in particular, the connectors 14 and 15 and also the centering ring 9 with its bushing guide 11, is formed from conductive material, so that a current path is formed by way of the bushing guide 11, by which a sliding bearing for the moving contact connection pin is also formed, the centering ring 9 and the connectors 14 and 15, it being possible for a current which is guided via the vacuum interrupter to at least partially flow via said current path to the connection region 2 of the connection piece 1 and therefore to the electrically conductive current-carrying parts of the switchgear assembly which are connected to the connection piece 1.

Figure 2:
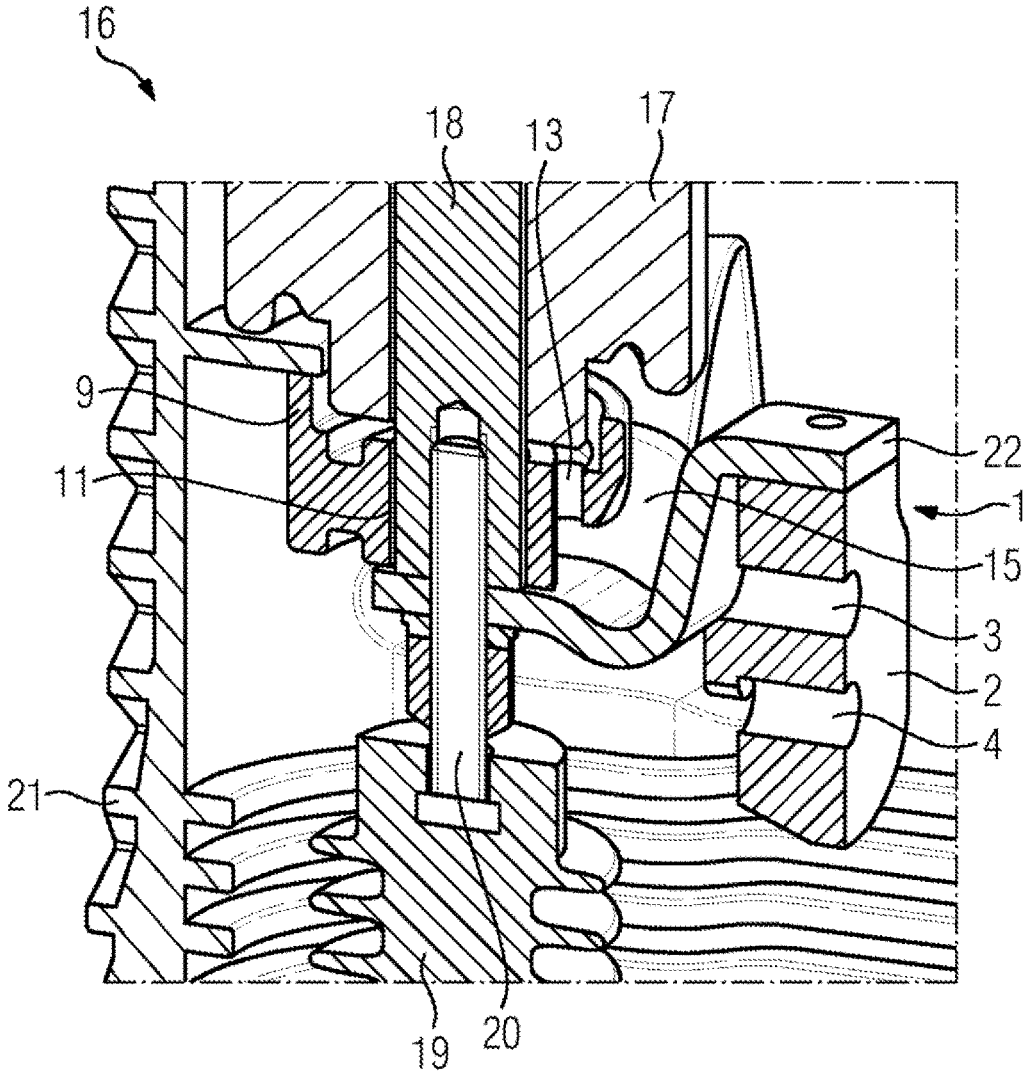
FIG. 2 shows a partial section view through a switch pole of a switching apparatus comprising a connection piece according to an example embodiment of the invention.

FIG. 2 shows a partial section view through a switch pole 16 of a switching apparatus, not illustrated any further in the figures, which can be provided, for example, as a medium-voltage circuit breaker for a switchgear assembly for energy distribution and is typically formed by way of three phases with in each case one switch pole 16 for each phase. The switch pole 16 comprises a vacuum interrupter 17 which has a contact system (not illustrated any further in the figures) comprising a moving contact and a fixed contact.

The moving contact is mechanically coupled via a moving contact connection pin 18 and an insulating drive rod 19 to a drive, likewise not illustrated any further in the figures, for introducing a drive movement into the moving contact connection pin 18 for the purpose of closing or opening the contact system and therefore for the purpose of switching or interrupting the current which is carried via the switch pole 16. To this end, the insulating drive rod 19 is mechanically coupled to the moving contact connection pin 18 by way of fastener 20.

The switch pole further comprises a pole housing 21 which is typically formed from an insulating material, for example epoxy resin or the like, and serves to electrically insulate the individual switch poles from one another and also from grounded housing components of the switching apparatus. The connection piece 1 is provided in the switch pole 16 for electrically conductive connection to the moving contact connection pin 18 and also for electrical connection to current-carrying parts, not illustrated in the figures, of the switchgear assembly in which the switching apparatus is inserted and is electrically conductively connected to the moving contact connection pin 18 via a flexible strip 22.

The moving contact connection pin 18 is guided in the bushing guide 11, an electrically conductive sliding bearing also being formed by said bushing guide 11 at the same time. Owing to the connection piece 1 being formed from a conductive material overall, a further current path to the connection region 2 of the connection piece 1 is formed by the sliding bearing of the bushing guide 11 and the connector 14 and 15, in addition to the flexible strip 22, so that a greater current-carrying capacity of the switch pole is ensured and formed by the connection piece 1 overall.

Owing to the bearing faces 12 of the bushing guide 11, mounting of the vacuum interrupter 17 in the switch pole is further simplified because it is no longer necessary to support the moving contact connection pin 18 separately during assembly, but rather a rotation-prevention device for the moving contact connection pin 18 is formed by the bearing faces 12. Furthermore, the ventilation openings 13 ensure a cooling effect on the entire region of the switch pole 16, so that the connection piece 1 overall provides the switch pole 16 of the switching apparatus with improved properties in respect of centering of the vacuum interrupter 17, guidance of the moving contact connection pin 18, current-carrying capacity and mounting.

LIST OF REFERENCE SYMBOLS

1 Connection piece
2 Connection region
3, 4 Fasteners
5, 6 Fasteners, strip
7, 8 Further Fasteners
9 Centering ring
10 Inside diameter
11 Bushing guide
12 Bearing face
13 Ventilation opening
14, 15 Connectors
16 Switch pole
17 Vacuum interrupter
18 Moving contact connection pin
19 Insulating drive rod
20 Fastener, insulator

21 Pole housing
22 Flexible strip

The invention claimed is:

1. A connection piece for a switch pole of a switching apparatus for electrically conductive connection to a moving contact connection pin of a vacuum interrupter arranged in the switch pole, the connection piece comprising:

a centering ring to center the vacuum interrupter, the centering ring being formed from an electrically conductive material and being electrically conductively connected to a connection region of the connection piece via at least one connector, wherein the centering ring includes ventilation openings.

2. The connection piece of claim 1, wherein the centering ring includes a bushing guide for the moving contact connection pin in the form of an electrically conductive sliding bearing.

3. The connection piece of claim 2, wherein the bushing guide is provided with bearing faces which correspond to a width across flats of the moving contact connection pin.

4. The connection piece of claim 1, wherein the bushing guide is provided with bearing faces which correspond to a width across flats of the moving contact connection pin.

5. A switching apparatus comprising the connection piece of claim 1.

6. The switching apparatus of claim 5, wherein the switching apparatus is a medium-voltage circuit breaker.

7. The switching apparatus of claim 5, wherein the connection piece is provided to electrically conductively connect the moving contact connection pin of the vacuum interrupter arranged in the switch pole, and to connect to a current-carrying component of a switchgear assembly, in which the switching apparatus is provided, to switch or interrupt a current carriable via the switchgear assembly.

8. The switching apparatus of claim 6, wherein the connection piece is provided to electrically conductively connect the moving contact connection pin of the vacuum interrupter arranged in the switch pole, and to connect to a current-carrying component of a switchgear assembly, in which the switching apparatus is provided, to switch or interrupt a current carriable via the switchgear assembly.

9. A switchgear assembly comprising the switching apparatus of claim 7.

10. A switchgear assembly comprising the switching apparatus of claim 8.

11. A switching apparatus comprising the connection piece of claim 2.

12. The switching apparatus of claim 11, wherein the switching apparatus is a medium-voltage circuit breaker.

13. The switching apparatus of claim 11, wherein the connection piece is provided to electrically conductively connect the moving contact connection pin of the vacuum interrupter arranged in the switch pole, and to connect to a current-carrying component of a switchgear assembly, in which the switching apparatus is provided, to switch or interrupt a current carriable via the switchgear assembly.

14. The switching apparatus of claim 12, wherein the connection piece is provided to electrically conductively connect the moving contact connection pin of the vacuum interrupter arranged in the switch pole, and to connect to a current-carrying component of a switchgear assembly, in which the switching apparatus is provided, to switch or interrupt a current carriable via the switchgear assembly.

15. A switchgear assembly comprising the switching apparatus of claim 13.

16. A switchgear assembly comprising the switching apparatus of claim 14.

* * * * *